US007007429B2

(12) United States Patent
Kim

(10) Patent No.: US 7,007,429 B2
(45) Date of Patent: Mar. 7, 2006

(54) VERTICAL DOWNSPOUTS FOR GUTTER SYSTEM

(76) Inventor: Jay Kim, 88 Pomona Rd., Suffern, NY (US) 10901

( * ) Notice: Subject to any disclaimer, the term of this patent is extended or adjusted under 35 U.S.C. 154(b) by 0 days.

(21) Appl. No.: 10/156,368

(22) Filed: May 28, 2002

(65) Prior Publication Data

US 2003/0221373 A1 Dec. 4, 2003

(51) Int. Cl.
*E04D 13/08* (2006.01)

(52) U.S. Cl. ..... 52/16; 52/13; 52/11; 52/287.1

(58) Field of Classification Search ..... 52/11–16, 52/288.1, 287.1, 302.1, 302.3; 285/183, 285/424; D23/267; 210/85, 87, 162, 159, 210/170, 238

See application file for complete search history.

(56) References Cited

U.S. PATENT DOCUMENTS 3,966,121 A * 6/1976 Littman ..... 239/197
4,106,243 A * 8/1978 Horn ..... 52/16
4,615,153 A * 10/1986 Carey ..... 52/12
5,220,755 A * 6/1993 Roles ..... 52/16
5,590,492 A * 1/1997 Cucchiara et al. ..... 52/15
5,882,508 A * 3/1999 St-Jacques ..... 210/87
5,985,158 A * 11/1999 Tiderington ..... 210/767
6,041,555 A * 3/2000 Alpi ..... 52/11
6,263,618 B1 * 7/2001 Jones ..... 52/12

FOREIGN PATENT DOCUMENTS

CA 1188-476 * 11/1985
JP 5-148965 * 6/1993
JP 5-230959 * 9/1993

* cited by examiner

*Primary Examiner*—Carl D. Friedman
*Assistant Examiner*—Chi Q. Nguyen
(74) *Attorney, Agent, or Firm*—McCarter & English, LLP

(57) ABSTRACT

The downspouts attach to the building by flanges extending from the downspout. The downspouts are attachable to standard gutters and elbows. At the corner of a building, downspouts are attachable to each wall forming the corner and an insert extends between the two downspouts to create a seamless appearance. Siding, brick, or other wall covering for the building extends from the downspouts. Downspouts also can be used in a corner or building, the inside corner of a building having a pair of flanges attachable to the building. Also, the downspouts can be attachable to a post, such as on a porch. The downspout may also contain a right-angle turn. In a right-angle turn, a trap is provided for the easy cleaning of the vertical downspout.

13 Claims, 10 Drawing Sheets

FIG.11
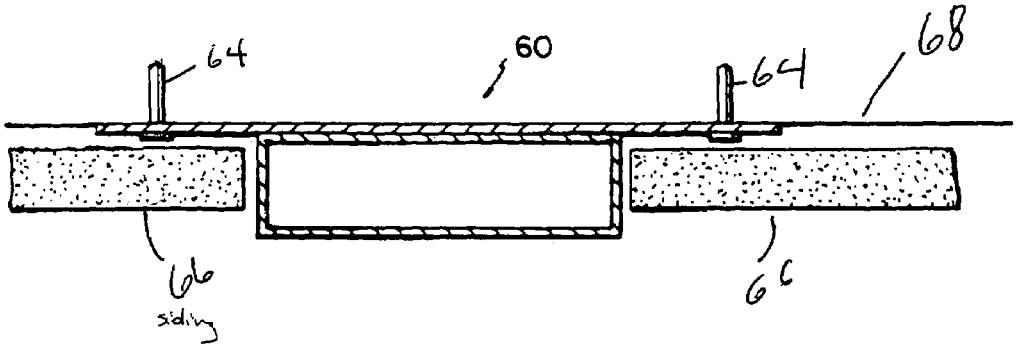
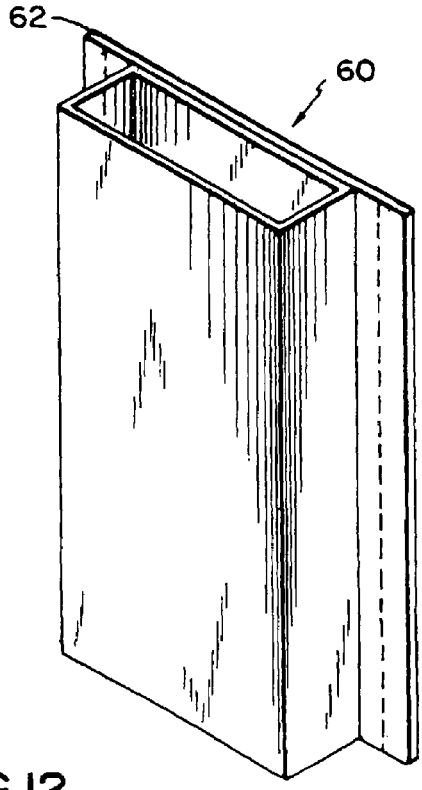
FIG.12

VERTICAL DOWNSPOUTS FOR GUTTER SYSTEM

FIELD OF THE INVENTION

The invention pertains to vertical downspouts connected to gutters for removing rain water.

BACKGROUND OF THE INVENTION

Gutters with downspouts are used to remove rain water falling upon roofs of houses and buildings. Water is directed toward the edge of the roof and into a gutter. Openings in the bottom of the gutter allow for removal of the water. Vertical downspouts extend from these openings and transport the water to ground level where it is dissipated. Downspouts are considered functional necessities and are not normally esthetically pleasing.

The prior art discloses drainage systems including downspouts intended to blend with the roof and building structure so as to be inconspicuous. One such system is disclosed in U.S. Pat. No. 5,590,492 (Cucchiara et al.). The system uses a trough 20 to collect water from the roof. Collected water is transported under the eaves by a soffit channel 30, which connects with a hollow L-shaped spout post 35. The vertically extending spout post is connected to the building, over the siding, at a corner, with each leg of the soffit post covering a different wall. Another spout post 50, shown in FIG. 7, functions as a combined pillar and drain spout.

U.S. Pat. No. 1,597,104, (O'Donnell) discloses a building tile and wall construction having a gutter 40 with a gutter spout 41 leading to a space between walls 29, 30. A sewer conduit 43 carries water from between these walls.

U.S. Pat. No. 6,357,183, (Smith), discloses a water conservation system having a gutter depositing water within a reservoir. A supply line extends from the reservoir to inside wall 34, comprising a stud frame of timber or metal, as shown in FIG. 2.

SUMMARY OF THE INVENTION

In one embodiment of this invention there is provided downspouts attached to a building by flanges extending from the downspout. The downspouts are attached to standard gutters and elbows. At the corner of a building, downspouts are attached to each wall forming the corner and an insert extends between the two downspouts to create a seamless appearance. Siding, brick, or other wall covering for the building extends from the downspouts.

In another aspect of this invention, downspouts also can be used in the inside corner of the middle of a wall of a building by a pair of flanges attached to the building.

In yet another aspect of this invention, the downspouts can be attached to a post, such as on a porch.

In still another embodiment, the downspout may also contain a right-angle turn. In a right-angle turn, a trap is provided for the easy cleaning of the vertical downspout.

In accordance with this invention there is provided a gutter system has a downspout with an upper end, a lower end, and a passageway for transporting water. A first flange extends from the downspout for attaching the downspout to a building.

A gutter system has a locking channel with a first leg and a second leg and a first clip on said first leg and a second clip on said second leg. A first downspout has a clip mating with the clip on the first leg of the locking channel. A second downspout has a clip mating with the clip on the second leg of the locking channel.

Also in accordance with this invention there is a building has a roof with at least one post supporting the roof. A gutter is attached to the edge of the roof and a downspout connected to said gutter for receiving collect water from the gutter. The post has a width and the downspout has a width substantially equal to the width of the at least one post.

A building has a wall with a first edge and a second edge. A gutter extends along a top of the wall and a downspout is attached to the wall at a location spaced from the first and second edge.

A building has a first wall and a second wall, said first joined to one another to form an inside corner. A downspout is attached to the inside corner and has a first wall extending along said building first wall and a second wall extending along said building second wall.

A method of replacing a downspout includes attaching a first downspout to a building wall by securing a flange of the downspout to the building wall. The flange is cut from the first downspout and the first downspout is removed. A second downspout is secured to the building wall by a flange. The second downspout flange is smaller than said first downspout flange It is an object of the invention to provide vertical downspouts blending with the siding of the building.

It is another object of the invention to provide vertical downspouts usable with standard gutters and elbows.

It is another object of the invention to provide gutters which are easily replaced if damaged.

It is another object of the invention to provide vertical downspouts which are easy to install and repair.

It is another object of the invention to provide a gutter system that can be used at an inside corner of a building or on posts, such as on a porch.

Another object of the invention is to provide a vertical downspout system which is inexpensive and easy to manufacture.

These and other objects of the invention will become apparent to one of ordinary skill in the art after reading the disclosure of the invention.

BRIEF DESCRIPTION OF THE DRAWINGS

FIG. 11 is a view of a downspout in the middle of a wall; and

FIG. 12 is a view of a middle-wall downspout.

DETAILED DESCRIPTION OF THE INVENTION

Figure 1:
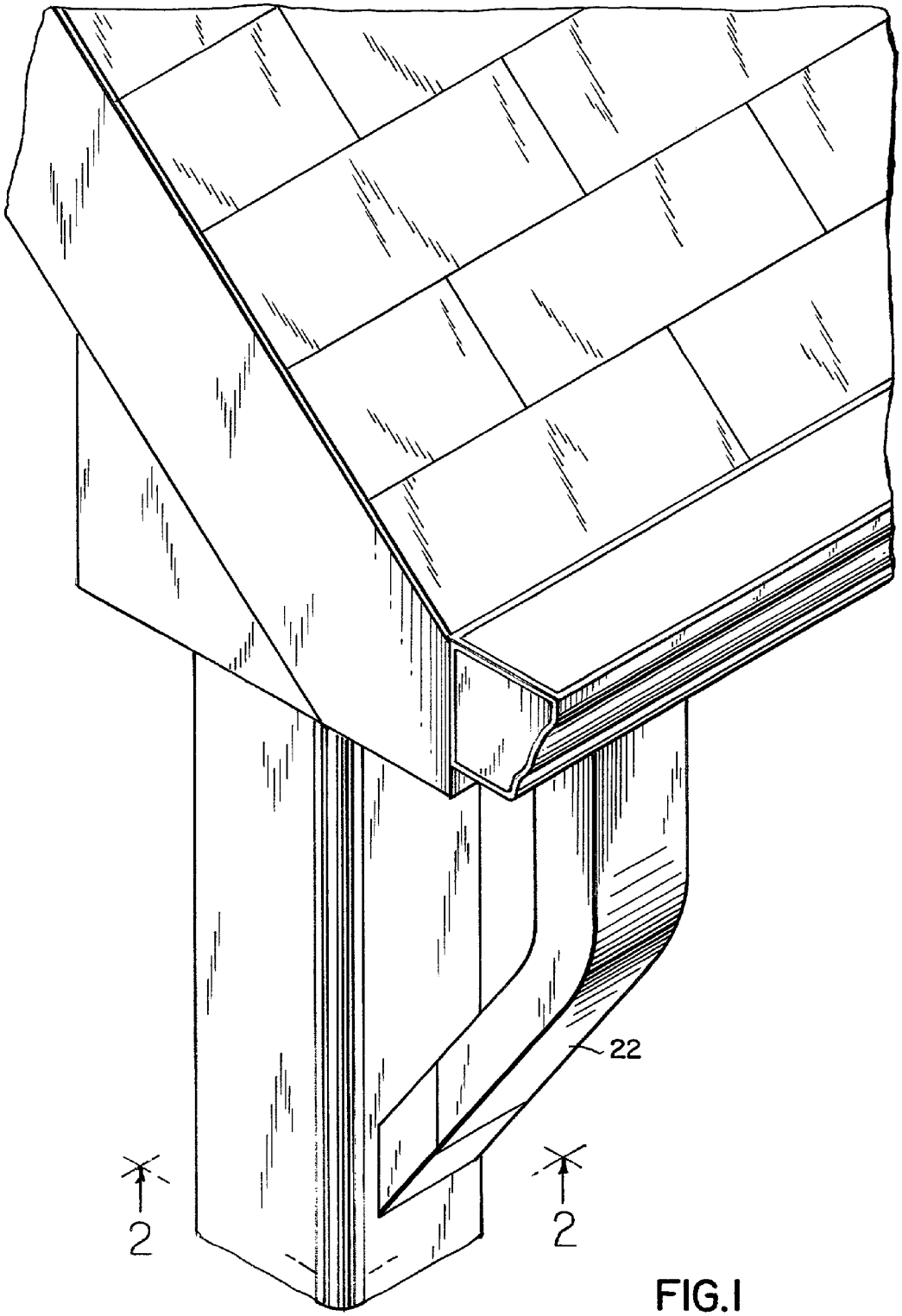
FIG. 1 shows the connection between a vertical downspout and a gutter via an elbow.

The vertical downspouts 13 of the invention can be seen in FIG. 1. The vertical downspouts are connected to standard gutters via a standard elbow to receive and transport water collected from the roof of the building.

Figure 2:
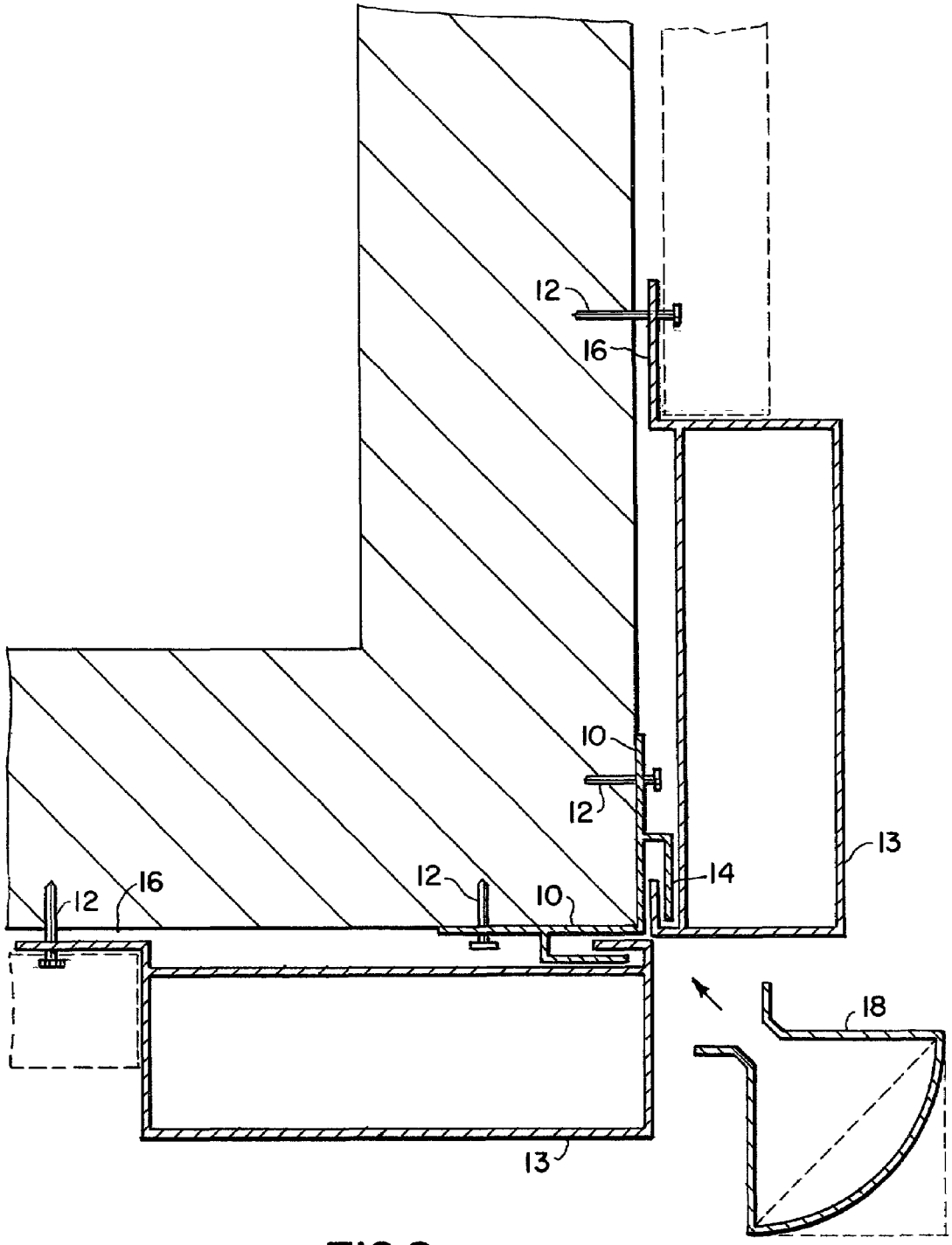
FIG. 2 is a cross-sectional view along line 2—2 in FIG. 1.

The attachment of the downspouts to the building is illustrated in FIG. 2. A locking channel 10 has two legs, each leg secured to a side of the building by such means as nails 12. On each leg, an L-shaped locking member 14 opens towards the corner of the building. A downspout 13 having a rectangular cross-section is placed along each wall of the corner. A downspout on each wall proves useful on buildings with hipped roofs having gutters along every edge.

Each downspout has a rectangular cross section allowing it to fit flush against the wall. A flange 16 extends from the rear wall of the downspout and is secured to the building nails 12. At the edge of the downspout opposite the flange 16, each downspout has an L-shaped locking clip 15. The locking clip 15 fits between the locking channel 10 and the L-shaped, locking member 14, and is retained thereby. A corner insert 18 occupies a space between the two vertical downspouts 13, providing a transition between the two to give a neater appearance. The corner insert 18 terminates in flanges able to extend between the locking clips 15 and locking channel 10, to be secured in place. The corner insert may have a curved outer surface, resulting in a sector-shaped cross-section, or may have a rectangular cross-section, or triangular cross-section, both shown in phantom lines in the drawings. The corner insert 18 helps the downspout blend with the exterior of the building.

Figure 3:
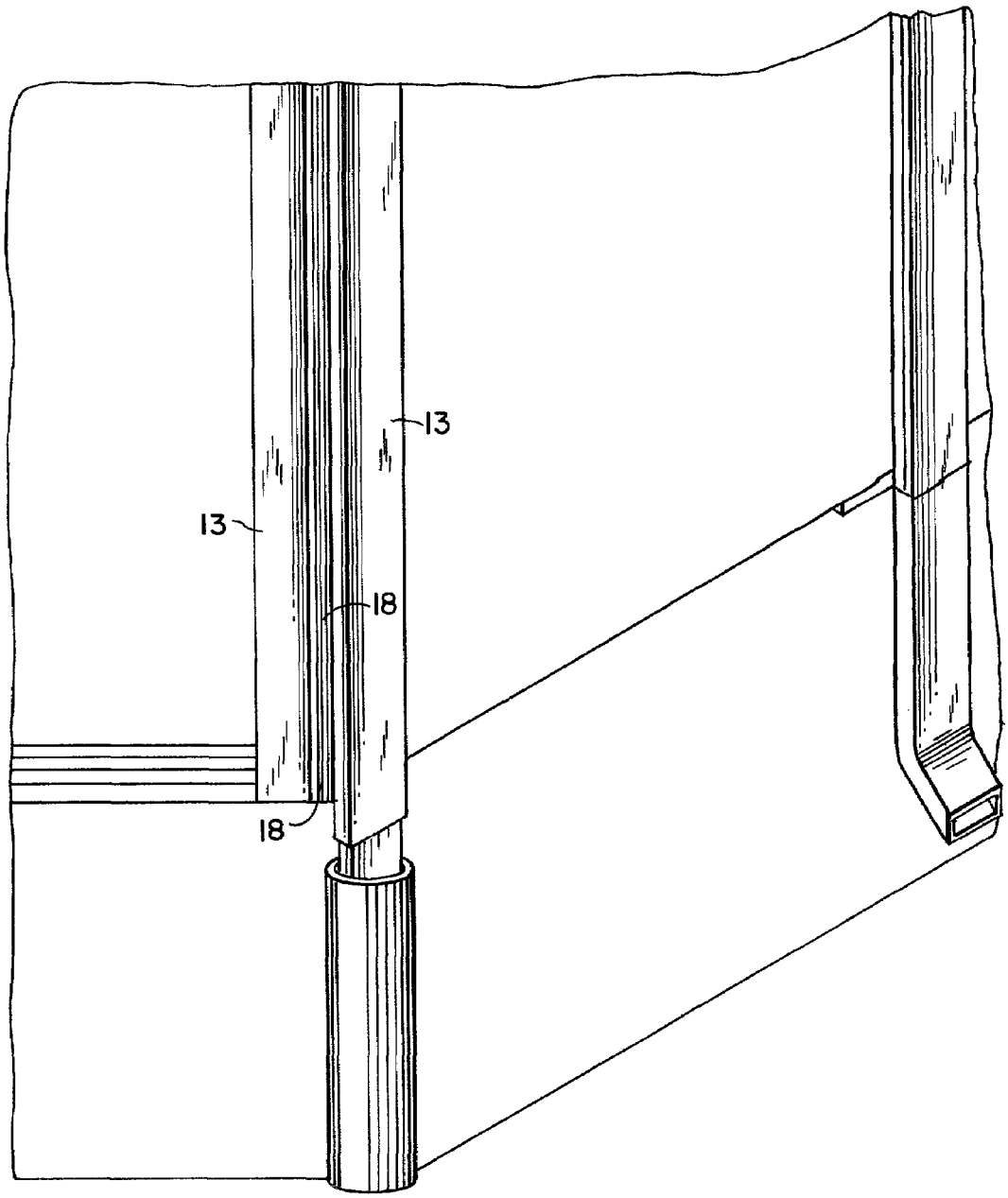
FIG. 3 is a view of the connection of a vertical downspout to a distributor spout.

FIG. 3 shows the bottom end of the vertical downspouts. The bottom end of the vertical downspout can end in an elbow to direct water away from the building, or empty into a conduit extending into the ground.

Figure 4:
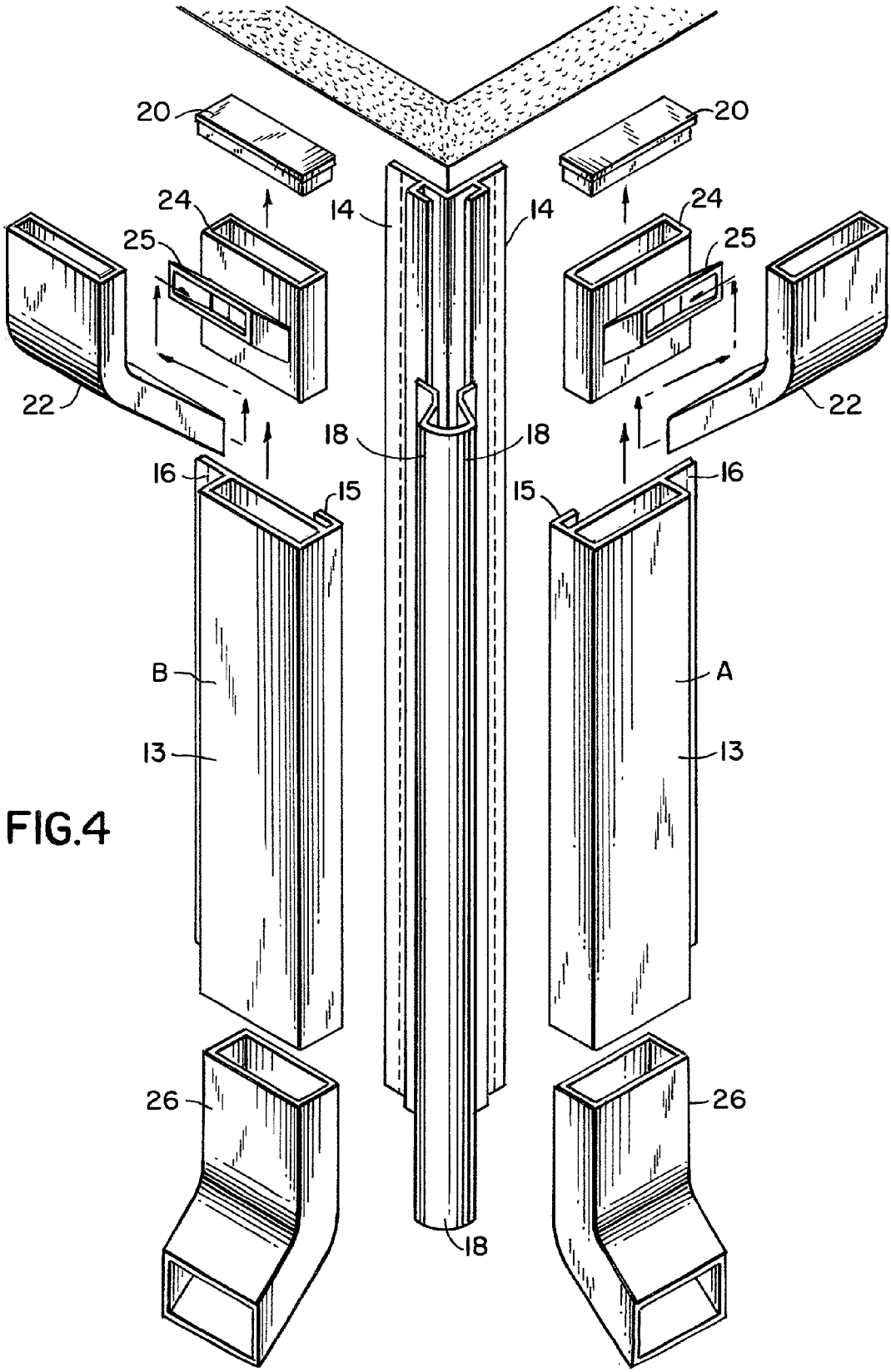
FIG. 4 is an exploded view of the components of the invention.

An exploded view of all the components comprising the vertical downspout system is shown in FIG. 4. Shown in this view is the locking channel 10 having the L-shaped locking members 14 on each leg. Also seen are the vertical downspouts 13 having a flange 16 extending from the vertical downspouts 13 for attachment to the side of the building and the locking clips 15 for engagement with the L-shaped locking members 14 on the locking channel 10. The corner insert 18 having flanges locking with the L-shaped locking members 14 in a manner similar to the locking clips 15 is also shown. If the downspout becomes damaged, the downspout can be removed by cutting the flange from the downspout. A replacement downspout having a shorter flange can be attached to the building by inserting nails at an angle.

Rectangular-shaped draining spouts 26, attachable to the end of the vertical downspouts for directing water away from the building, are seen. Also seen in this view is connection module 24 attachable to the top end of the vertical downspouts 13. Connection module 24 has an opening surrounded by a flange 25 for connection to an elbow 22. The opening attaches to a standard elbow attached to a gutter. A standard elbow for residential systems has a rectangular cross section. The other end of the elbow 22 connects to a gutter. Of course, the downspout 13 and connection module 24 can be formed as one piece.

A cap 20 covers the top of the connection module 24. The cap permits access to the downspout for cleaning. Also, if an obstruction causes water to build up within the vertical downspout, the cap is designed to pop off to release water. The downspouts can be made in any width; widths of 4", 5", 6", or 12" are presently contemplated. A 12" width is foreseen for a building having siding material such as vinyl siding, brick or stucco sides with a downspout that is covered with brick or stucco to match.

Figure 5:
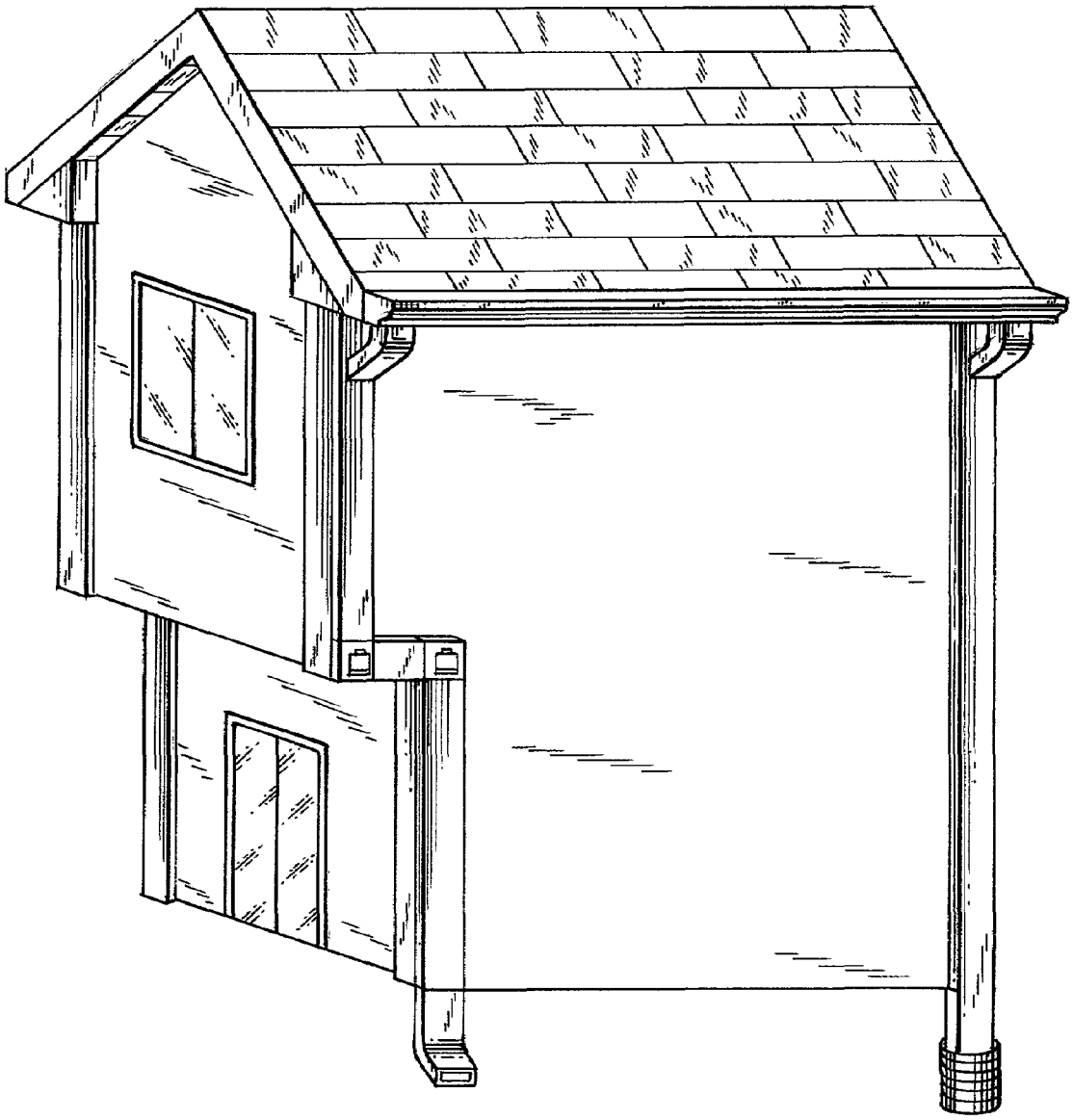
FIG. 5 is a view of vertical downspouts having a right-angle turn.

The downspout can turn at right angles to follow the contour of the building side wall, as shown in FIG. 5. As can be seen, both sections of the downspout follow the corner of the building for the entire length of the building.

Figure 6:
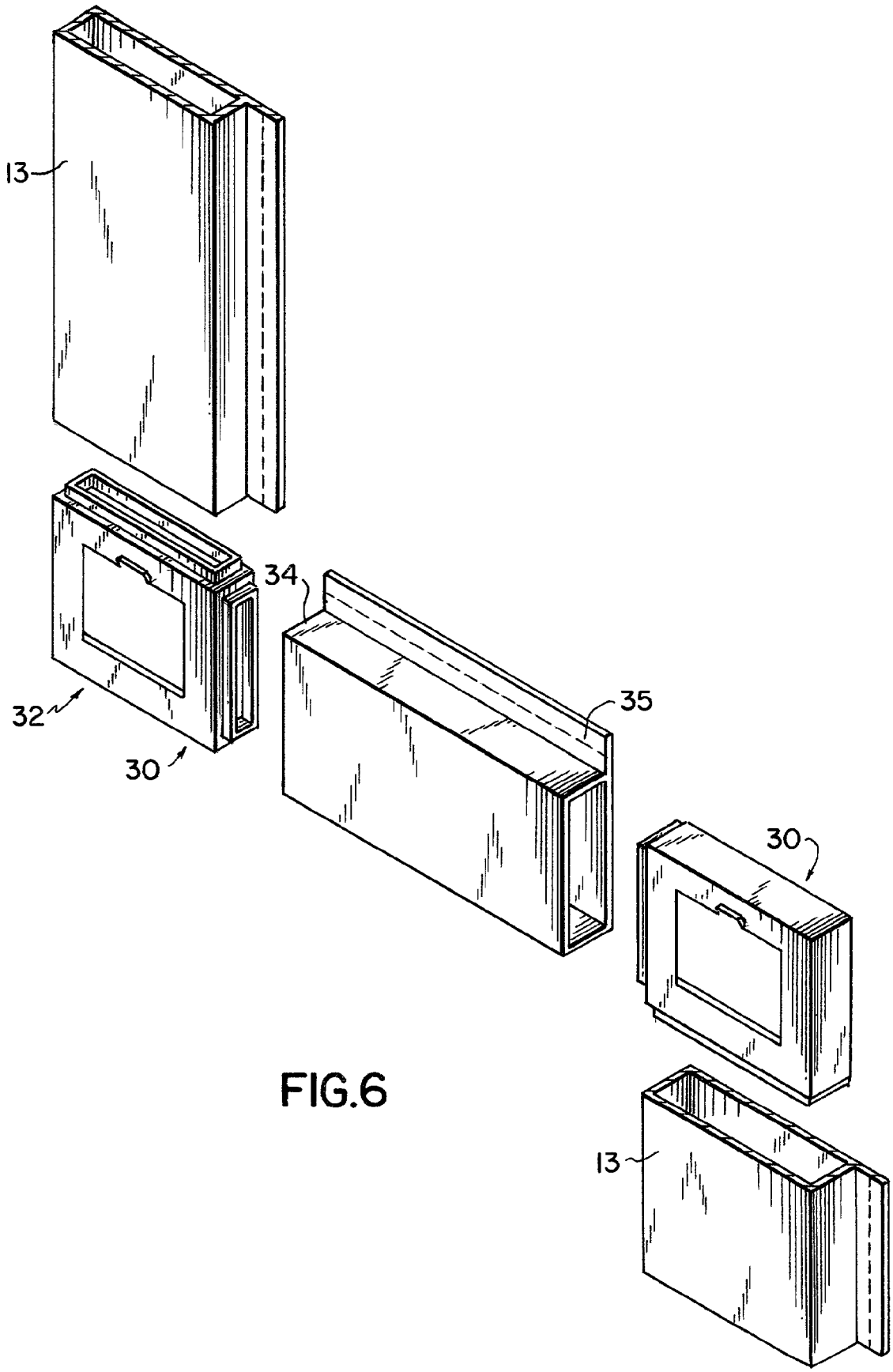
FIG. 6 is an exploded view of right-angle turn provided with a trap.

The sections of vertical downspouts used to create a right-angle turn are shown in the exploded view of FIG. 6. A first section of vertical downspout 13 is connected to an elbow 30 having an opening in the top and one side. Connected to the opening in the side of the elbow 30 is horizontal section 34 having a flange 35 for attachment to the building side wall. This horizontal section of downspout is connected to a second elbow having an opening in the side and a second opening in the bottom. A second section of vertical downspout 13 connects to the opening in the bottom of the second elbow 30. A trap 32 in each elbow allows for the easy cleaning of any collected debris.

Figure 7:
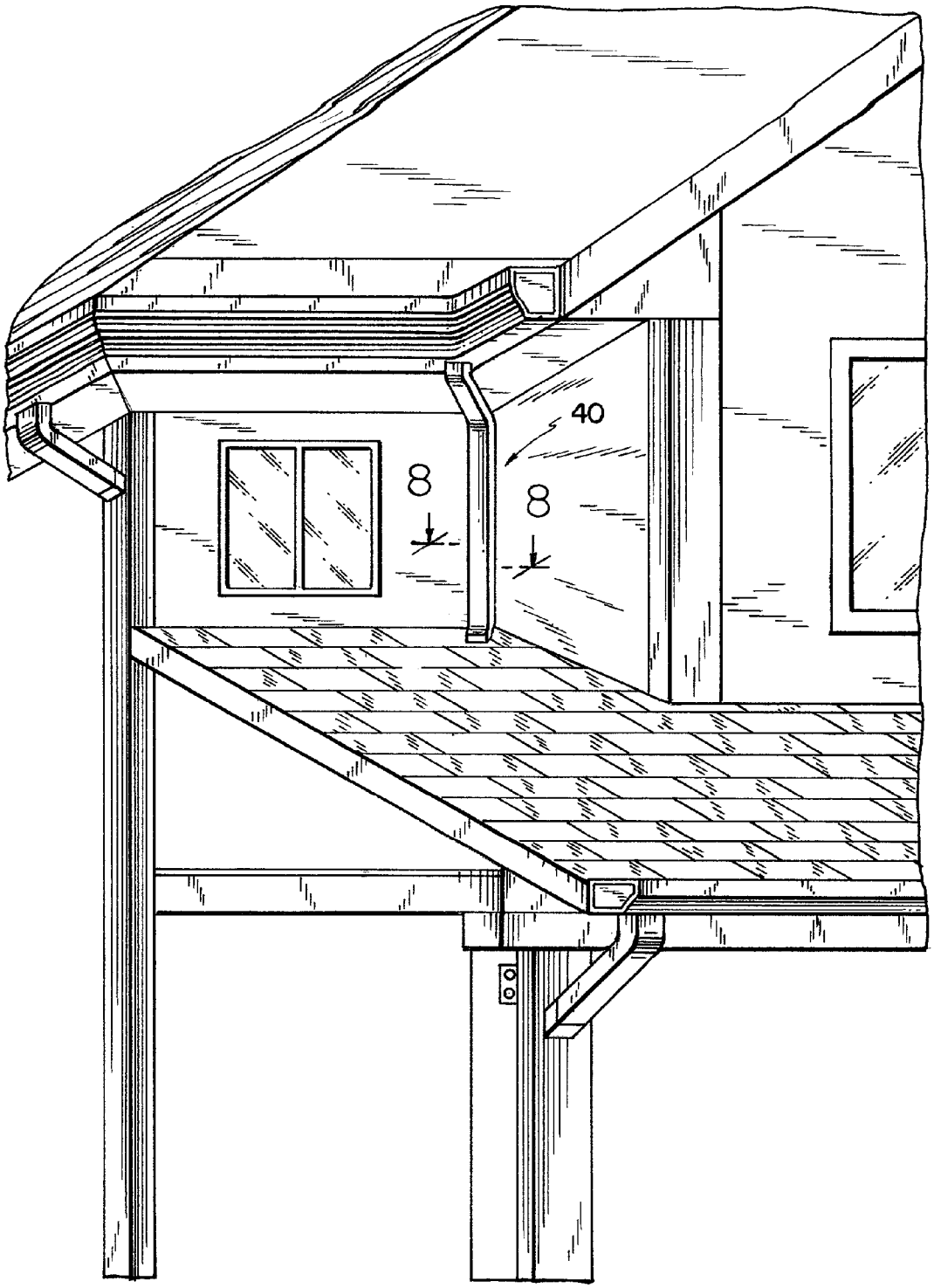
FIG. 7 is a view of a vertical downspout on the inside corner of a structure.
Figure 8:
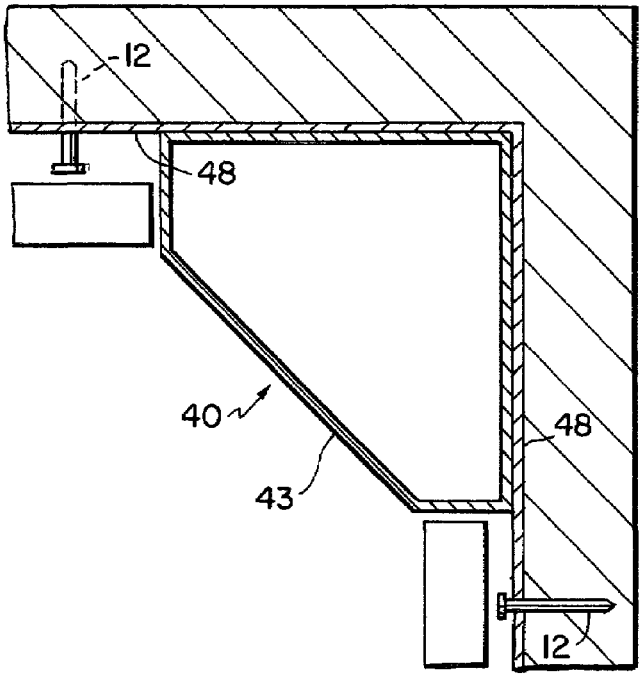
FIG. 8 is a view along line 8—8 of FIG. 7.
Figure 9:
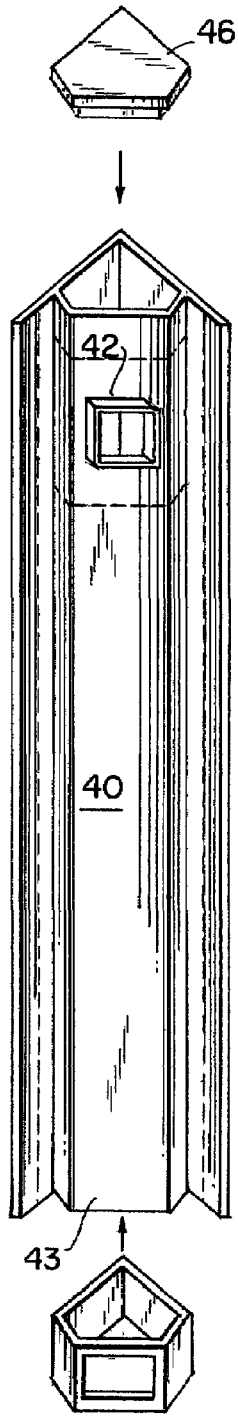
FIG. 9 is an exploded view of an inside corner.

A vertical downspout 40 for the inside corner of the building is shown in FIG. 7. The details of the inside corner downspout are shown in the cross-section view of FIG. 8. The inside corner downspout has a pair of flanges 48 attachable to the building side wall by nails 12. The shape of the inside corner downspout conforms to the corner of the building and has an outer wall 43 providing a streamlined transition between the siding attached to the wall. While a streamlined transition is shown, any shaped outer wall 43 could be used, as desired by the user. FIG. 9 shows an exploded view of the inside corner downspout having a top cap 46 serving the same function as the cap 20 previously described. An opening is surrounded by a flange 42 for receiving an elbow attachable to a gutter. The opening and flange are shown unitarily formed with the downspout 40, but can be formed as two pieces as discussed in the reference to the outside corner downspout discussed previously.

Figure 10:
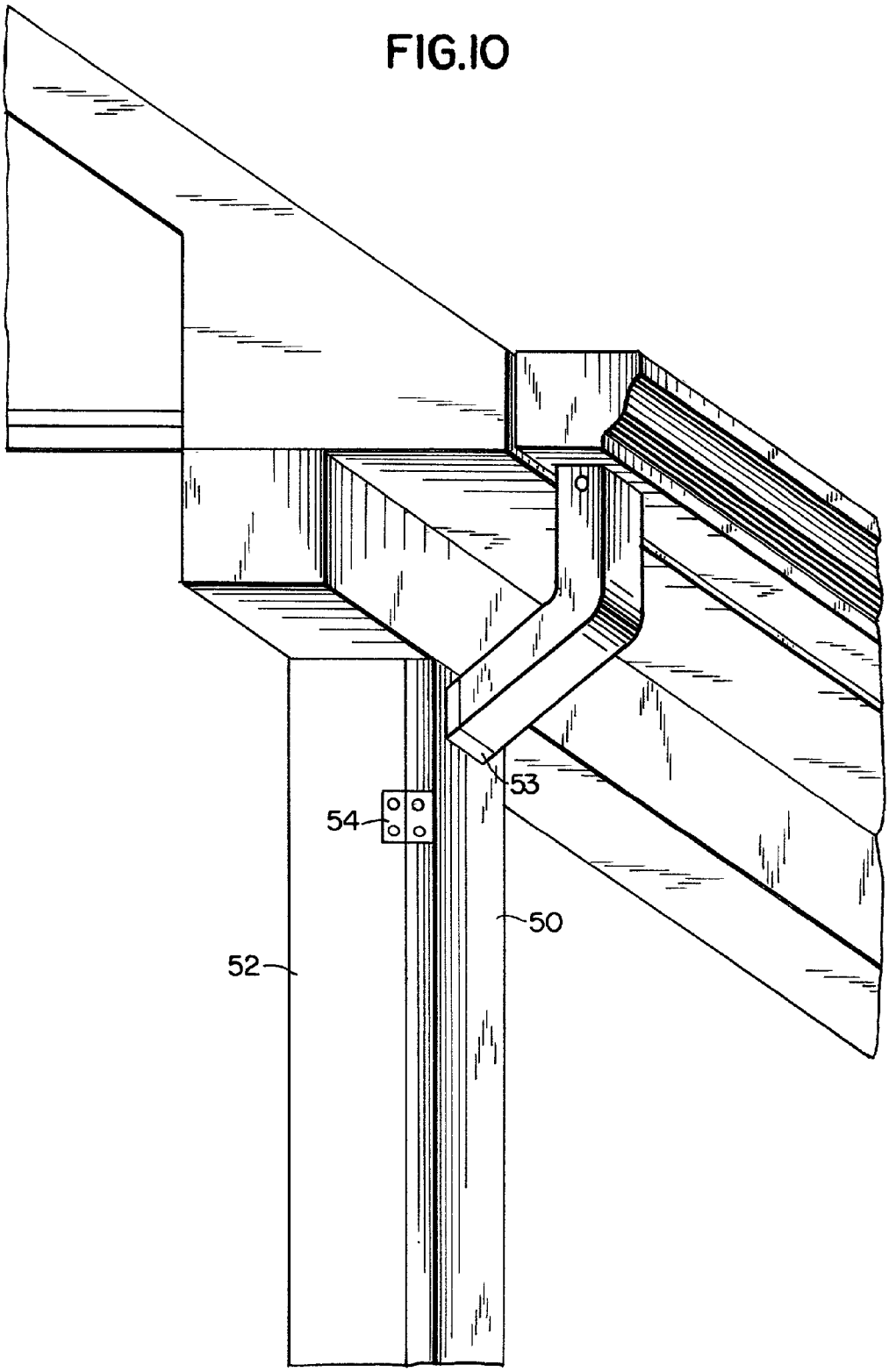
FIG. 10 is a view of a downspout connected to a post.

An embodiment of a vertical downspout connected to a post is shown in FIG. 10. This embodiment is particularly useful for gutters attached to a porch roof. A post 52 supports the roof and there is no side to attach a downspout. A downspout 50 having a width equal to the post 52 is secured to the post by a bracket 54. The downspout is provided with an opening surrounded by a flange 53 for receiving an elbow attachable to the gutter.

In some instances, it is desirable to provide a downspout in the center of a wall, rather than in a corner. For such an instance, a downspout 60 is provided with a pair of flanges 62 extending from either side of the downspout. The flanges are attachable to the side wall by such a means as nailing.

FIG. 11 shows such an arrangement of a downspout 60 attached to a side wall by any suitable means, such as nails 64 which are used to attach the flanges 62 to the wall 68. Siding 66 may then be secured over the flanges 62 so as to hide the flanges 62 to make a more pleasing appearance. FIG. 12 shows the downspout 60 not attached to a wall. In this view, the flanges 62 for attaching the downspout to the wall 68 are clearly seen.

While the invention has been described with reference to preferred embodiments, variations or modifications would be apparent to one of ordinary skill in the art without departing from the scope of the invention. Consequently, the appended claims should not be limited to their literal terms, but should be broadly construed in accordance with the scope of the invention, as described above.

What is claimed:

1. A gutter system comprising a downspout having an upper end, a lower end, a passageway for transporting water, a first vertical section, a first right-angle section connected to said first vertical section, a first horizontal section connected to said first right-angle section, a second right-angle section connected to said first horizontal section, a second vertical section connected to said second right-angle section and first and second flanges extending from said downspout substantially in a plane for attaching said downspout to a wall of a building, said first flange extending from said first vertical section, said first horizontal section, and said second vertical section; and a trap door in one of said first and second right-angle sections.

2. The gutter system of claim 1, wherein said downspout has a first opening proximate said upper end for connecting said downspout to a gutter and a second opening proximate said lower end for the egress of water.

3. The gutter system of claim 1, further comprising a top cap attached to said upper end of said downspout.

4. The gutter system of claim 1, wherein said downspout has a rear wall, said first flange extending from said rear wall, and a clip attached to said rear wall.

5. The gutter system of claim 4, wherein said clip is L-shaped.

6. A gutter system comprising:

first and second downspouts, each of said first and second downspouts having an upper end, a lower end, and a passageway for transporting water;

first and second flanges extending from each of said first and second downspouts substantially in a plane for attaching a corresponding one of said first and second downspouts to a wall of a building; and a corner insert extending between said first and second downspouts, wherein said corner insert has a sector-shaped, triangular or rectangular cross-section.

7. The gutter system of claim 1, wherein said downspout is covered with siding material of the building.

8. The gutter system of claim 7, wherein said siding material is vinyl siding, brick or stucco.

9. The gutter system of claim 1, further comprising an opening, said opening having a rectangular shape to receive an elbow having a rectangular cross section.

10. A gutter system, comprising:

a locking channel, said locking channel having a first leg and a second leg;

a first locking member on said first leg and a second locking member on said second leg;

a first downspout, said first downspout having a clip mating with said locking member on said first leg of said locking channel; and a second downspout, said second downspout having a clip mating with said locking member on said second leg of said locking channel.

11. The gutter system of claim 10, further comprising:

a first flange extending from said first downspout for connecting said first downspout to a building; and a second flange extending from said second downspout for connecting said second downspout to a building.

12. The gutter system of claim 10, further comprising a corner insert extending between said first and second downspouts.

13. The gutter system of claim 12, wherein said corner insert has a pair of side walls, each side wall terminating in clips, said corner insert clips mating with said first and second locking member of said locking channel.

* * * * *